US006264195B1

(12) United States Patent
Hoberock et al.

(10) Patent No.: US 6,264,195 B1
(45) Date of Patent: Jul. 24, 2001

(54) SHEET MATERIAL SUPPLY TRAY WITH AUTOMATIC SIZE ADJUSTMENT

(75) Inventors: Tim M. Hoberock, Boise; Angela K. DiFronzo, Meridian, both of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/288,049

(22) Filed: Apr. 7, 1999

(51) Int. Cl.[7] ..... B65H 9/00

(52) U.S. Cl. ..... 271/226; 271/145; 271/171; 271/233

(58) Field of Search ..... 271/8.1, 226, 233, 271/234, 236, 238, 239, 240

(56) References Cited

U.S. PATENT DOCUMENTS

| | | | | |
|---|---|---|---|---|
| 4,607,834 | * | 8/1986 | Dastin | 271/171 |
| 5,572,310 | * | 11/1996 | Hoberock et al. | 399/370 |
| 5,901,952 | * | 5/1999 | Hourtash | 271/171 |

OTHER PUBLICATIONS

Hewlett–Packard Laserjet ® 4000 Service Manual, FIG. 300 & Table 2–4–1, 1997.

* cited by examiner

*Primary Examiner*—Donald P. Walsh
*Assistant Examiner*—Mark J. Beauchaine

(57) ABSTRACT

An adjustable tray for holding a supply of sheet material is provided. The tray includes a selectively movable backstop, and a selectively movable slide plate. An adjustment mechanism is provided that is selectively movable between an automatic position in which adjustment of the backstop affects adjustment of the slide plate, and a custom position in which adjustment of the backstop is independent of adjustment of the slide plate. The adjustment mechanism can be provided as a rod element. The backstop can be movable within a predetermined range of motion, in which case the adjustment mechanism can be adapted to move the slide plate to a position outside the range of motion of backstop. In an embodiment, the rod element is adapted to move the slide plate forward of backstop's range of motion. The tray can further include a plurality of levers, mounted on the tray, corresponding to respective sheet material sizes. The slide plate can include a plate member including a plurality of holes, with the slide plate being movable to selectively expose the levers. An actuation mechanism can be mounted on the tray. The actuation mechanism can be adapted to move the adjustment mechanism between its automatic and custom positions. In an embodiment, the actuation mechanism is provided as a switch disposed on an outside surface of the tray. A method for adjusting a sheet material tray to accommodate different sheet material sizes in an imaging system is also provided.

20 Claims, 2 Drawing Sheets

SHEET MATERIAL SUPPLY TRAY WITH AUTOMATIC SIZE ADJUSTMENT

FIELD OF THE INVENTION

The present invention relates generally to media trays for sheet material feed systems in imaging devices. Specifically, the present invention relates to sheet material supply trays with automatic size adjustment mechanisms to accommodate broad ranges of media for sheet material cassette trays.

BACKGROUND OF THE INVENTION

The ever-changing demands of global commerce, coupled with the almost unlimited capabilities of state-of-the-art imaging systems, has resulted in a need for a wide variety of document types and formats. The days of "letter or legal" have gone the way of carbon paper and mimeographs. Imaging systems are capable of handling a variety of standard sizes, such as letter, legal, A4, and A5-ISO, as well as custom sheet sizes.

Rather than require system users to have on hand a different sheet tray for each sheet size, it is known to provide cassette trays having the ability to handle a relatively wide range of sizes. Such trays are sometimes provided with sliding rear adjustable "backstops" which may accommodate different sheet lengths, and/or side slide-plates adjustable to communicate sheet size information to the printer central control system.

Two approaches to sheet size adjustability are exemplified by the optional 500-sheet tray and the standard 250-sheet tray associated with the Hewlett-Packard LaserJet 4000T printer. The optional 500-sheet tray supports standard sheet sizes, as well as custom sizes. The sheet size in the tray is communicated to the printer by contact with combinations of three levers on the side of the tray. The levers are capable of selective contact with switches on the interior of the sheet infeed housing when the tray is inserted into the printer. Each sheet size is associated with a unique set of lever positions. The levers are moved in and out by the slide-plate, which is mounted on the side of the tray. The slide-plate is provided with a plurality of holes corresponding to the lever combinations associated with the various sheet sizes. Levers are prevented from actuating their associated switches when the levers are aligned with holes, and can actuate switches when they are aligned with the "flats", or closed portions of the slide-plate. The slide-plate is moved by turning a dial located on the side of the tray, which serves to push or pull the slide-plate. The printer user is required to manually set the dial for each paper size, which may be perceived as inconvenient.

The standard 250-sheet trays are equipped to automatically sense sheet size. The backstop of the tray is movable, and is mechanically linked to the slide-plate. When the backstop is moved to positions corresponding to standard sizes, the slide-plate is moved to a position exposing the proper levers, as with the optional 500-sheet tray. Although adjustment of the tray communicates differences between standard sizes automatically, the standard tray is unable to accommodate custom sizes.

Another typical adjustable tray is that associated with the Optra S2450 printer manufactured by Lexmark. The Optra S2450 operates in much the same way as the LaserJet 4000 standard tray, but also permits adjustment for some custom sizes. The Optra 2450 slide-plate has holes for standard sizes. When the backstop moves the slide-plate to a non-standard position, all levers are actuated, thus setting the switches to read a custom size. Unfortunately, the backstop and slide-plate of the Optra 2450 tray are incapable of independent adjustment. Consequently, the Optra S2450 tray cannot accommodate custom sheet sizes having the same length as standard sizes.

It can thus be seen that the need exists for a user-friendly sheet material tray that will accommodate a wide variety of standard and custom sizes.

SUMMARY OF THE INVENTION

These and other objects are achieved by providing an adjustable tray for holding a supply of sheet material. The tray includes a selectively movable backstop, and a selectively movable slide plate. An adjustment mechanism is provided that is selectively movable between an automatic position in which adjustment of the backstop affects adjustment of the slide plate, and a custom position in which adjustment of the backstop is independent of adjustment of the slide plate.

The adjustment mechanism can be provided as a rod element. The backstop can be movable within a predetermined range of motion, in which case the adjustment mechanism can be adapted to move the slide plate to a position outside the range of motion of backstop. In an embodiment, the rod element is adapted to move the slide plate forward of backstop's range of motion.

The tray can further include a plurality of levers, mounted on the tray, corresponding to respective sheet material sizes. The slide plate can include a plate member including a plurality of holes, with the slide plate being movable to selectively expose the levers.

An actuation mechanism can be mounted on the tray. The actuation mechanism can be adapted to move the adjustment mechanism between its automatic and custom positions. In an embodiment, the actuation mechanism is provided as a switch disposed on an outside surface of the tray.

A method for adjusting a sheet material tray to accommodate different sheet material sizes in an imaging system is also provided. In the first steps of the method, a selectively movable backstop adapted to contact the rear edge of the stack of sheet material and a selectively movable slide plate are provided. The backstop and the slide plate are moved simultaneously to accommodate a first stack of sheet material in the tray, and the first stack of sheet material is inserted in the tray. The imaging system is then operated to use at least one sheet from the first stack of sheet material. Next, the first stack of sheet material is removed from the tray, and the backstop and the slide plate are moved independently to accommodate a second stack of sheet material in the tray. The second stack of sheet material is inserted in the tray, and the imaging system is operated to use at least one sheet from the second stack of sheet material.

DETAILED DESCRIPTION OF THE INVENTION

Figure 1:
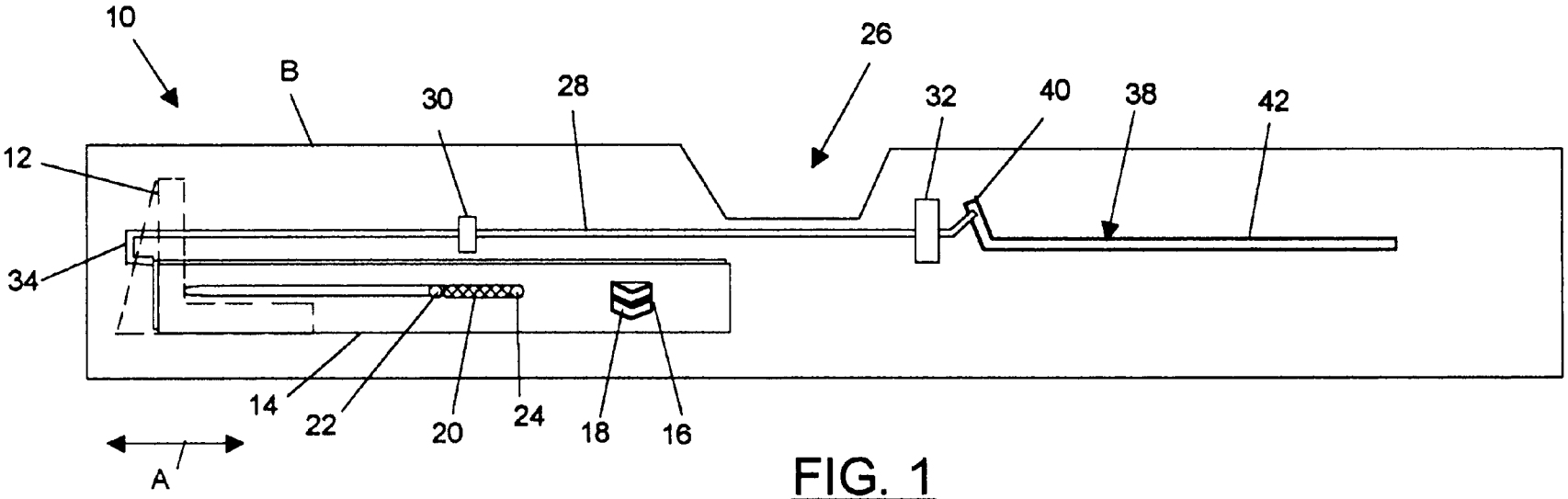
FIG. 1 is a schematic side elevational illustration of a tray adjustment mechanism in accordance with the principles of the present invention.

A tray assembly 10 in accordance with the principles of the present invention is illustrated in FIG. 1. The tray assembly 10 is of the type associated with imaging devices, such as printers and copiers, and is adapted to receive stacks of sheet material such as paper, transparencies, and the like. The tray assembly 10 includes a backstop 12, shown in broken line for clarity, and a slide-plate 14. The backstop 12 and slide-plate 14 are mechanically linked for simultaneous movement in a manner similar to that shown in the LaserJet 4000 standard 250-sheet tray, as is known to those of skill in the art.

The slide-plate 14 is provided with a plurality of holes 16. The slide-plate 14 is reciprocally moveable in the directions indicated by arrow A to selectively allow the protrusion of a plurality of levers 18 through the holes 16. A return assist spring 20 is secured between a first spring post 22 fastened to the tray body B and a second spring post 24 attached to the slide-plate 14. The return assist spring 20 aids in returning the slide-plate to its original position as shown in FIG. 1.

An adjustment mechanism 26 is provided to be selectively movable between an automatic position (shown in FIG. 1) in which adjustment of the backstop 12 affects adjustment of the slide-plate 14, and a custom position (shown in FIG. 2) in which adjustment of the backstop 12 is independent of adjustment of the slide-plate 14. The adjustment mechanism 26 includes a reciprocable rod 28 secured to the tray body B by clips 30, 32. The rod 28 is provided with a contact end 34 capable of contact with the slide-plate 14. Opposite the contact end 34, the rod 28 is provided with an actuation mechanism 36 (FIG. 3) that extends outwardly from the tray 10 through a slot 38. The slot 38 includes an angled portion 40 contiguous with a generally horizontal portion 42.

In FIG. 1, the actuation mechanism 36 is in an "up" position in the angled portion 40 of the slot 38. In this position, the adjustment mechanism 26 is in its "automatic" position, and the slide-plate 14 moves simultaneously with the backstop 12. The levers 18 extend through the holes 16, corresponding to a standard sheet size. The contact end 34 of the rod 28 has no effect on the position of the slide-plate 14.

Figure 2:
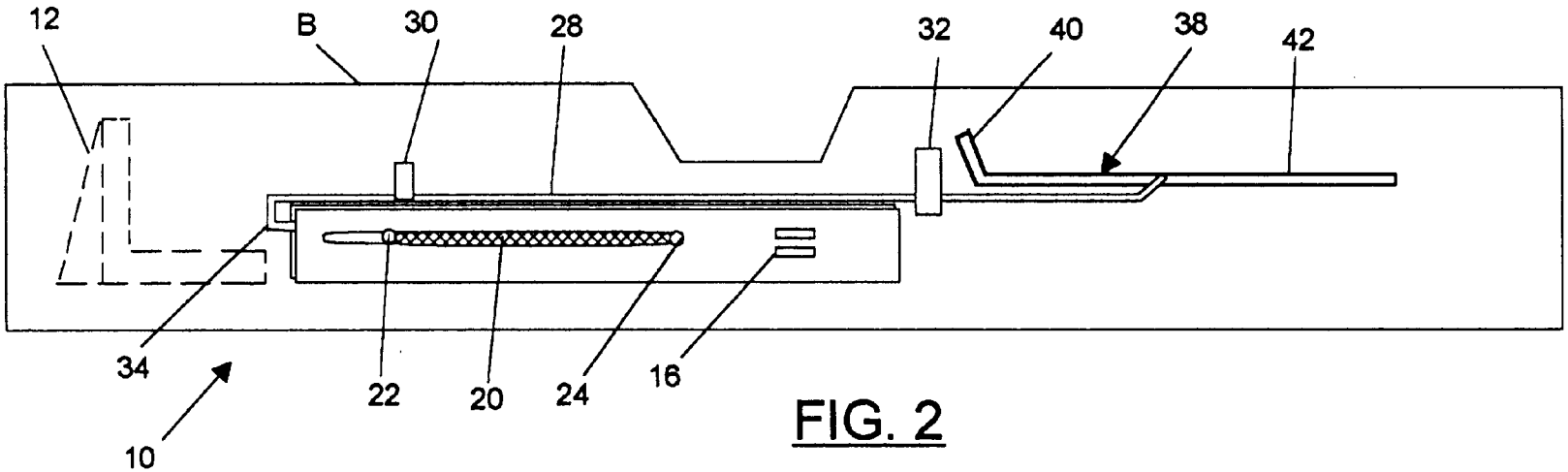
FIG. 2 is a schematic side elevational illustration of the FIG. 1 tray adjustment mechanism in its custom position.
Figure 3:
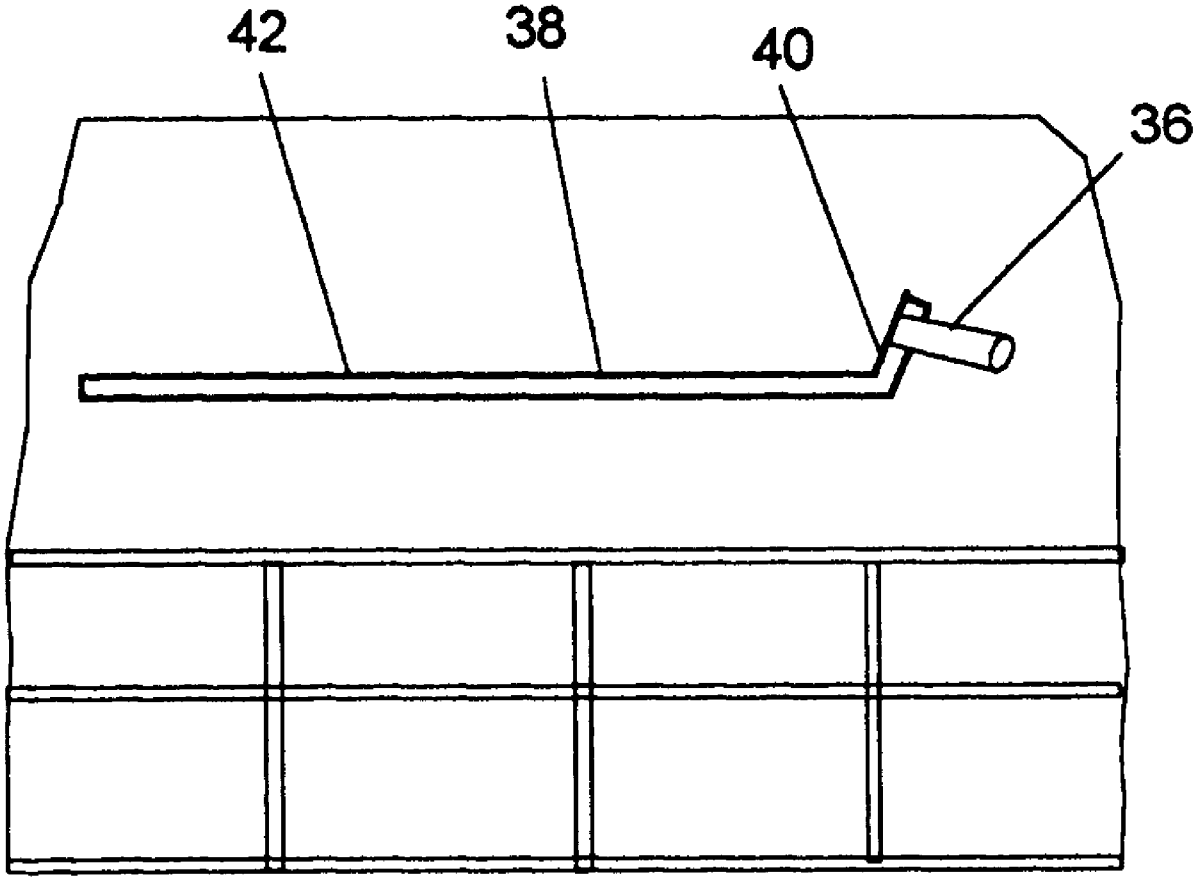
FIG. 3 illustrates an exterior side elevational view of the tray adjustment mechanism shown in FIGS. 1 and 2.

In FIG. 2, the actuation mechanism 36 is in a "down" position in the horizontal portion 42 of the slot 38. In this position, the adjustment mechanism 26 is in its "custom" position, and the slide-plate 14 moves independently of the backstop 12. The contact end 34 of the rod 28 has moved the slide-plate to a position forward of the range of motion of the backstop 12, such that movement of the backstop 12 will have no effect on the position of the slide-plate 14. The combination of holes 16 misaligned with the levers 18 indicates to the imaging device control system (through the infeed switches) that a custom size has been inserted.

In operation, with the adjustment mechanism 26 in the FIG. 1 position, the backstop 12 and the slide plate 14 are moved simultaneously by the operator to accommodate a first stack of sheet material in the tray 10, and the first stack of sheet material is inserted in the tray 10. The imaging system is then operated to use at least one sheet from the first stack of sheet material. Next, the first stack of sheet material is removed from the tray 10, and the backstop 12 and the slide plate 14 are moved independently to accommodate a second stack of sheet material in the tray. The second stack of sheet material is inserted in the tray 10, and the imaging system is operated to use at least one sheet from the second stack of sheet material.

The present invention permits the typical printer operator, who uses only letter, legal, A4, executive, B5, and A5 standard sizes to do so without any additional manual adjustments of the universal tray for printer communication of sheet size. Movement of the backstop would affect movement of the slide-plate. Other users would be able to load any custom size, even those with lengths identical to standard sheets, with a simple external adjustment.

Although the present invention has been described with reference to specific embodiments, those of skill in the art will recognize that changes may be made thereto without departing from the scope and spirit of the invention.

What is claimed is:

1. An adjustable tray for holding a supply of sheet material, the tray comprising the following:

a selectively movable backstop;

a selectively movable slide plate; and an adjustment mechanism selectively movable between an automatic position in which adjustment of the backstop affects adjustment of the slide plate, and a custom position in which adjustment of the backstop is independent of adjustment of the slide plate.

2. An adjustable tray in accordance with claim 1, wherein the adjustment mechanism comprises a rod element.

3. An adjustable tray in accordance with claim 2, wherein the backstop is movable within a predetermined range of motion, and the adjustment mechanism is adapted to move the slide plate to a position outside the range of motion of the backstop.

4. An adjustable tray in accordance with claim 3, wherein the rod element is adapted to move the slide plate forward of the backstop's range of motion.

5. An adjustable tray in accordance with claim 1, further comprising a plurality of levers, mounted on the tray, corresponding to respective sheet material sizes.

6. An adjustable tray in accordance with claim 5, wherein the slide plate comprises a plate member including a plurality of holes, the slide plate being movable to selectively expose the levers.

7. An adjustable tray in accordance with claim 1, further comprising an actuation mechanism mounted on the tray and adapted to move the adjustment mechanism between its automatic and custom positions.

8. An adjustable tray in accordance with claim 7, wherein the actuation mechanism comprises a switch disposed on an outside surface of the tray.

9. In an imaging system including a sheet material infeed arrangement, an adjustable tray for holding a supply of sheet material in a stack having front, rear, and side edges, the tray comprising the following:

a selectively movable backstop adapted to contact the rear edge of the stack of sheet material;

a selectively movable slide plate; and an adjustment mechanism selectively movable between an automatic position in which adjustment of the backstop affects adjustment of the slide plate, and a custom position in which adjustment of the backstop is independent of adjustment of the slide plate.

10. An adjustable tray in accordance with claim 9, wherein the adjustment mechanism comprises a rod element.

11. An adjustable tray in accordance with claim 10, wherein the backstop is movable within a predetermined range of motion, and the adjustment mechanism is adapted to move the slide plate to a position outside the range of motion of backstop.

12. An adjustable tray in accordance with claim 11, wherein the rod element is adapted to move the slide plate forward of backstop's range of motion.

13. An adjustable tray in accordance with claim 9, further comprising a plurality of levers, mounted on the tray, corresponding to respective sheet material sizes.

14. An adjustable tray in accordance with claim 13, wherein the slide plate comprises a plate member including a plurality of holes, the slide plate being movable to selectively expose the levers.

15. An adjustable tray in accordance with claim 9, further comprising an actuation mechanism mounted on the tray and adapted to move the adjustment mechanism between its automatic and custom positions.

16. An adjustable tray in accordance with claim 15, wherein the actuation mechanism comprises a switch disposed on an outside surface of the tray.

17. In an imaging system including a sheet material infeed arrangement and an adjustable tray for holding a supply of sheet material in a stack having front, rear, and side edges, a method for adjusting the tray to accommodate different sheet material sizes, the method comprising the following steps:

providing a selectively movable backstop adapted to contact the rear edge of the stack of sheet material;

providing a selectively movable slide plate;

moving the backstop and the slide plate simultaneously to accommodate a first stack of sheet material in the tray;

inserting the first stack of sheet material in the tray;

operating the imaging system to use at least one sheet from the first stack of sheet material;

removing the first stack of sheet material from the tray;

moving the backstop and the slide plate independently to accommodate a second stack of sheet material in the tray;

inserting the second stack of sheet material in the tray; and operating the imaging system to use at least one sheet from the second stack of sheet material.

18. A method in accordance with claim 17, further comprising the step of providing an adjustment mechanism selectively movable between an automatic position in which adjustment of the backstop affects adjustment of the slide plate, and a custom position in which adjustment of the backstop is independent of adjustment of the slide plate.

19. A method in accordance with claim 18, wherein the step of moving the backstop comprises moving the backstop within a predetermined range of motion, and wherein the step of moving the backstop and the slide plate independently is preceded by moving the adjustment mechanism to place the slide plate in a position outside the range of motion of the backstop.

20. A method in accordance with claim 19, wherein the step of moving the adjustment mechanism comprises placing the slide plate in a position forward of backstop's range of motion.

* * * * *

UNITED STATES PATENT AND TRADEMARK OFFICE

CERTIFICATE OF CORRECTION

PATENT NO. : 6,264,195 B1
DATED : July 24, 2001
INVENTOR(S) : Hoberock et al.

It is certified that error appears in the above-identified patent and that said Letters Patent is hereby corrected as shown below:

Column 3,
Line 54, should read -- moved by a printer operator simultaneously --;

Signed and Sealed this

Sixth Day of July, 2004

JON W. DUDAS
*Acting Director of the United States Patent and Trademark Office*